US011053764B2

(12) United States Patent
Armilli et al.

(10) Patent No.: US 11,053,764 B2
(45) Date of Patent: Jul. 6, 2021

(54) HANG OFF RAM PREVENTER

(71) Applicant: Cameron International Corporation, Houston, TX (US)

(72) Inventors: Gabriele Armilli, Montpellier (FR); Teddy Rames, Beziers (FR); Florent Vargas, Beziers (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/243,989

(22) Filed: Jan. 9, 2019

(65) Prior Publication Data

US 2020/0217167 A1 Jul. 9, 2020

(51) Int. Cl.
*E21B 33/06* (2006.01)

(52) U.S. Cl.
CPC ..... *E21B 33/062* (2013.01)

(58) Field of Classification Search
CPC ..... E21B 33/06; E21B 33/061; E21B 33/062
See application file for complete search history.

(56) References Cited

U.S. PATENT DOCUMENTS 2,912,214 A 11/1959 Herbert
3,880,436 A * 4/1975 Canal ..... E21B 33/062 277/325
4,518,144 A * 5/1985 Vicic ..... E21B 33/062 251/1.3
4,553,730 A * 11/1985 Vicic ..... E21B 33/062 251/1.3
4,703,938 A * 11/1987 Fox ..... E21B 33/062 277/325
4,770,387 A * 9/1988 Granger ..... E21B 33/062 251/1.1
5,005,802 A * 4/1991 McWhorter ..... E21B 33/062 251/1.3
5,009,289 A * 4/1991 Nance ..... E21B 19/10 188/67
5,013,005 A 5/1991 Nance
5,180,137 A * 1/1993 Carlson ..... E21B 33/062 251/1.3
5,575,451 A 11/1996 Colvin et al.
6,089,526 A * 7/2000 Olson ..... E21B 33/062 251/1.3
6,296,225 B1 * 10/2001 Watts ..... E21B 33/062 251/1.3
8,727,303 B2 5/2014 Araujo et al.
2015/0275610 A1 * 10/2015 Tan ..... E21B 33/062 166/382
2017/0101841 A1 * 4/2017 Araujo ..... E21B 33/062
2017/0159391 A1 * 6/2017 Dev ..... B29C 45/1676

* cited by examiner

*Primary Examiner* — Umashankar Venkatesan

(57) ABSTRACT

A ram type blowout preventer is designed to provide substantial hang off capability. Improved hang off capacity is provided by the ram bodies having shaped upper centralizing lobes and/or semi-circular or U-shaped central openings. In particular, the interface between the upper centralizer lobe and central opening is tapered such that the hang off load is spread over a larger area of each ram body.

16 Claims, 9 Drawing Sheets

HANG OFF RAM PREVENTER

TECHNICAL FIELD

The present disclosure relates to blowout preventers. More specifically, the present disclosure relates to ram type blowout preventers that have improved hang off capabilities. Even more specifically, the present disclosure relates to ram type blowout preventers that have improved hang off capabilities.

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

In well drilling operations such as in the oil and gas industry, blowout preventers (BOPS) are an important safety "valve" for well pressure control. BOPs typically use elastomer packer elements for sealing around a pipe. In addition to providing sealing functionality, some BOPs may provide hang off capability. Hang off is generally when the BOP supports the weight of that portion of the drill string below the BOP. The axial hang off load can be supported by a tool joint resting on the closed BOP. Ordinarily certain types of ram BOPs can be designed to provide hang off capability.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

According to some embodiments, a ram assembly is described that is used in a ram type blowout preventer configured to form a seal against a tubular member. The blowout preventer can a fixed size ram preventer a variable bore ram preventer. The ram assembly includes a packer assembly and a ram body. The packer assembly includes at least one elastomeric packer member having a substantially U-shaped face to form the seal against the tubular member. The ram body is configured to house said packer assembly and when actuated in a ram actuation direction towards the tubular member pushes said U-shaped face on the packer assembly against the tubular member. The ram body includes an upper U-shaped face generally aligned with the U-shaped face of the packer assembly and an upper centralizing lobe shaped and positioned to aid in moving the tubular member towards a central position with respect to the U-shaped faces of the packer assembly and ram body. The U-shaped face of the ram body and/or the upper centralizing lobe are shaped to improve hang off capacity of the preventer.

According to some embodiments, the improvement of hang off capacity is due at least in part on a tapered section formed at an intersection of the ram body U-shaped face and the upper centralizing lobe. According to some embodiments, the hang-off is improved compared to an otherwise identical preventer having a semi-circular U-shaped face that intersects directly with a main front face of the upper centralizing lobe. The tapered section can include a planar surface that is at an angle between 5 and 90 degrees from the ram actuation direction. In some cases the angle is between 10 and 75 degrees, 15 and 60 degrees, or 20 and 45 degrees. In some embodiments the angle is about 30 degrees.

According to some embodiments, the improvement of hang off capacity comes from the shape of the ram body U-shaped face and/or the upper centralizing lobe spreading the axial load of a tool joint over a larger area of the ram body above and adjacent to the U-shaped face of the ram body.

As used herein, the phrases "ram preventer," "ram-type preventer," "ram blowout preventer" and "ram-type blowout preventer" refer to a blowout preventer in which the pressure-control functions are achieved through the operation of hydraulically operated ram sets.

As used herein, the phrases "variable bore ram preventer" and "variable bore ram blowout preventer" refer to ram-type blowout preventers that are configured to enable sealing on two or more different pipe diameter sizes. Examples of pipe diameter sizes includes the international standard American Petroleum Institute (API) for steel drill-pipes for use in drilling and production operations in petroleum and natural gas industries. The API 5 DP specifies drill pipes in the following sizes: 2⅜", 2⅞", 3½", 4", 4½", 5", 5"½, and 6⅝". In the case of API 5 DP drill pipe sizes, a variable bore ram preventer are configured to enable sealing over a diameter range of at least ½". In some cases variable bore ram preventers such as Cameron's VBR preventers are configured to seal on pipes with diameters that differ by 1⅞" or more.

As used herein, the phrase "hang off" in the context of ram-type blowout preventers refers to when the BOP supports the weight of that portion of the drill string below the BOP. The axial hang off load is designed to be supported by a tool joint resting on the closed BOP.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
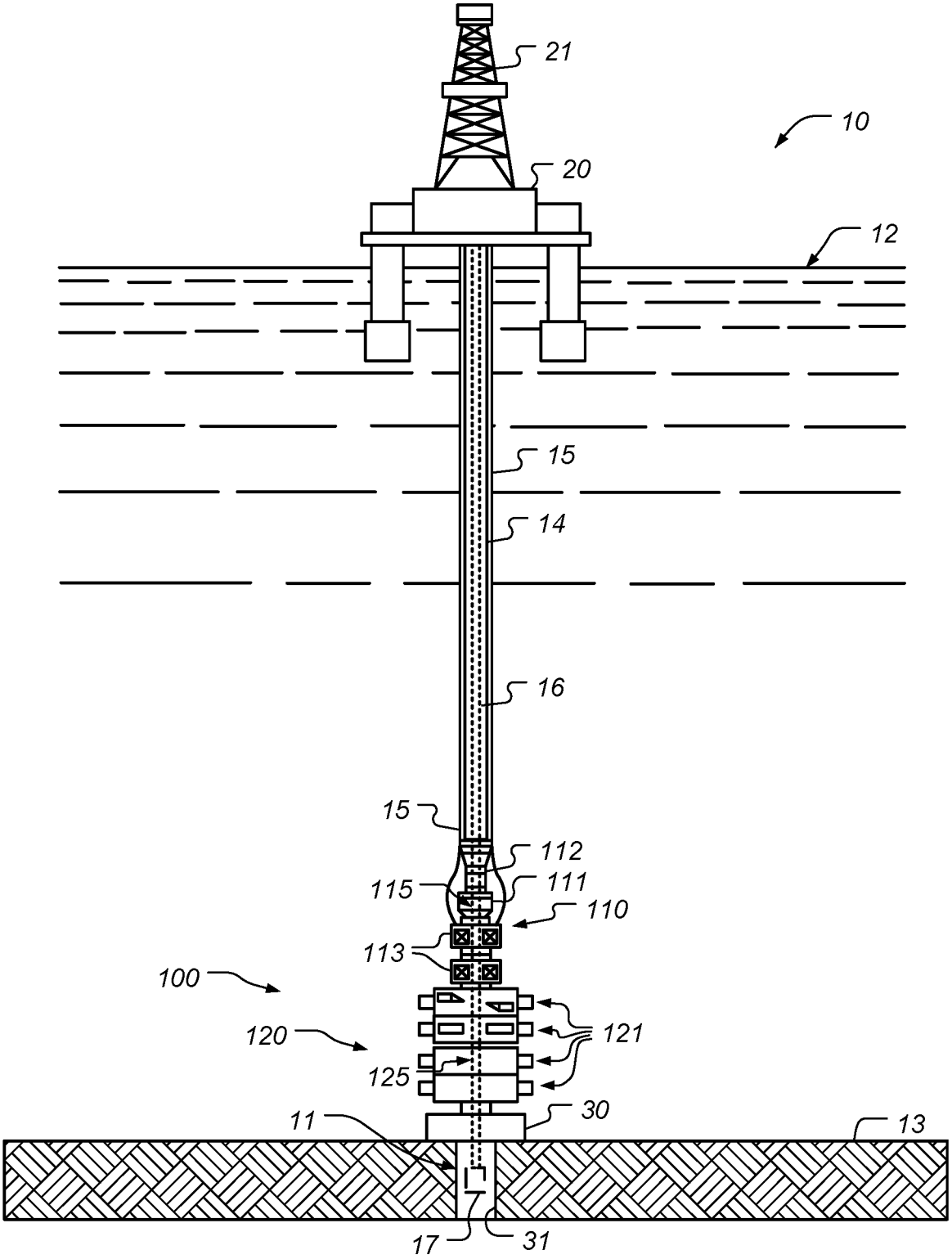
FIG. 1 is a diagram illustrating a drilling and/or producing wellsite where sealing using a ram type preventer having improved hang off, according to some embodiments.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The particulars shown herein are for purposes of illustrative discussion of the embodiments of the present disclosure only. In this regard, no attempt is made to show structural details of the present disclosure in more detail than is necessary for the fundamental understanding of the present disclosure, the description taken with the drawings making apparent to those skilled in the art how the several forms of the present disclosure may be embodied in practice. Like reference numerals represent similar or identical parts throughout the several views of the drawings.

According to some embodiments, a ram type BOP that has substantial hang off capacity is described. FIG. 1 is a diagram illustrating a drilling and/or producing wellsite where sealing using a ram type preventer having improved hang off, according to some embodiments. In this example, an offshore drilling system is being used to drill a wellbore 11. The system includes an offshore vessel or platform 20 at the sea surface 12 and a subsea blowout preventer (BOP) stack assembly 100 mounted to a wellhead 30 at the sea floor 13. The platform 20 is equipped with a derrick 21 that supports a hoist (not shown). A tubular drilling riser 14 extends from the platform 20 to the BOP stack assembly 100. The riser 14 returns drilling fluid or mud to the platform 20 during drilling operations. One or more hydraulic conduit(s) 15 extend along the outside of the riser 14 from the platform 20 to the BOP stack assembly 100. The conduit(s) 15 supplies pressurized hydraulic fluid to the assembly 100. Casing 31 extends from the wellhead 30 into the subterranean wellbore 11.

Downhole operations, such as drilling, are carried out by a tubular string 16 (e.g., drillstring) that is supported by the derrick 21 and extends from the platform 20 through the riser 14, through the BOP stack assembly 100, and into the wellbore 11. In this example, a downhole tool 17 is shown connected to the lower end of the tubular string 16. In general, the downhole tool 17 may comprise any suitable downhole tool(s) for drilling, completing, evaluating, and/or producing the wellbore 11 including, without limitation, drill bits, packers, cementing tools, casing or tubing running tools, testing equipment and/or perforating guns. During downhole operations, the string 16, and hence the tool 17 coupled thereto, may move axially, radially, and/or rotationally relative to the riser 14 and the BOP stack assembly 100.

The BOP stack assembly 100 is mounted to the wellhead 30 and is designed and configured to control and seal the wellbore 11, thereby containing the hydrocarbon fluids (liquids and gases) therein. In this example, the BOP stack assembly 100 comprises a lower marine riser package (LMRP) 110 and a BOP or BOP stack 120. The LMRP 110 includes a riser flex joint 111, a riser adapter 112, one or more annular BOPs 113, and a pair of redundant control units or pods. A flow bore 115 extends through the LMRP 110 from the riser 14 at the upper end of the LMRP 110 to the connection at the lower end of the LMRP 110. The riser adapter 112 extends upward from the flex joint 111 and is coupled to the lower end of the riser 14. The flex joint 111 allows the riser adapter 112 and the riser 14 connected thereto to deflect angularly relative to the LMRP 110, while wellbore fluids flow from the wellbore 11 through the BOP stack assembly 100 into the riser 14. The annular BOPs 113 each include annular elastomeric sealing elements that are mechanically squeezed radially inward to seal on a tubular extending through the LMRP 110 (e.g., the string 16, casing, drillpipe, drill collar, etc.) or seal off the flow bore 115. Thus, the annular BOPs 113 have the ability to seal on a variety of pipe sizes and/or profiles, as well as perform a "Complete Shut-off" (CSO) to seal the flow bore 115 when no tubular is extending therethrough.

A main bore 125 extends through the BOP stack 120. In addition, the BOP stack 120 includes a plurality of axially stacked ram BOPs 121. Each ram BOP 121 includes a pair of opposed rams and a pair of actuators that actuate and drive the matching rams. In the example depicted, the BOP stack 120 includes four ram BOPs 121. An upper ram can include opposed blind shear rams or blades for severing the tubular string 16 and sealing off the wellbore 11 from the riser 14. The three lower ram BOPs 121 include the opposed pipe rams for engaging the string 16 and sealing the annulus around the tubular string 16. According to some embodiments, one or more of the ram BOPs 121 can be variable bore ram (VBR) type BOPs. In other embodiments, the BOP stack (e.g., the stack 120) may include a different number of rams, different types of rams, one or more annular BOPs, or combinations thereof. According to some embodiments, one or more of the ram BOPs 121 include improved hang off capability.

Figure 2:
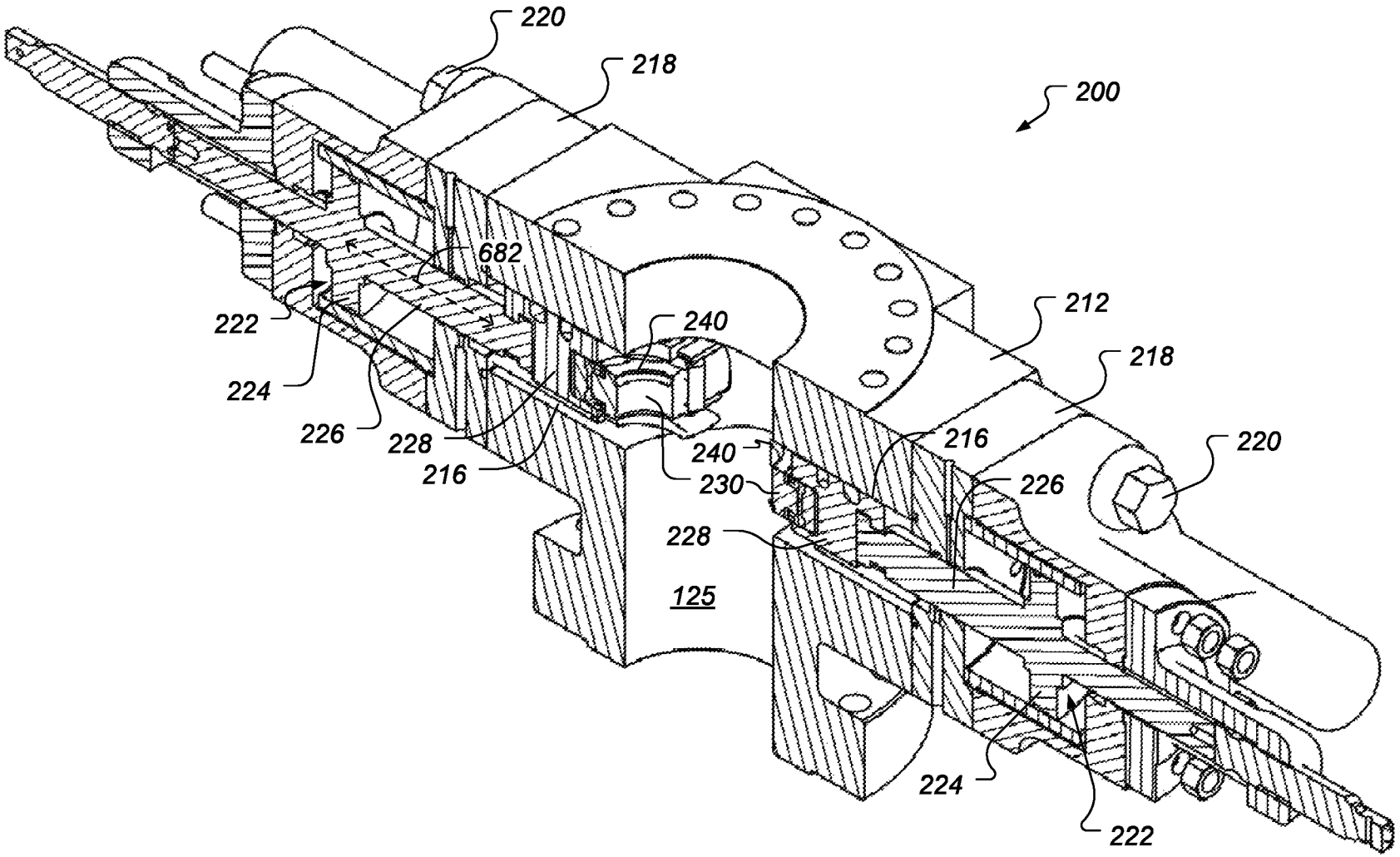
FIG. 2 is view of a ram type blowout preventer having improved hang off, according to some embodiments.

FIG. 2 is view of a ram type blowout preventer having improved hang off, according to some embodiments. Ram type blowout preventer 200 can be one of more of the BOPs 121 shown in FIG. 1. Ram type blowout preventer 200 includes a body or housing 212 with a vertical bore 125 and laterally disposed ram guideways 216. Bonnet assemblies 218 are mounted to the body 212 with suitable securing means such as studs or bolts 220 and aligned with laterally disposed guideways 216. Each bonnet assembly 218 includes an actuation means 222, including pistons 224 and connecting rods 226. Each connecting rod 226 is connected to a ram 228 assembly. Each of the ram assemblies 228 include a packer assembly 230. Actuation means 222 allows ram assemblies 228 and ram packer assemblies 230 to be reciprocated within guideways 216 or "opening and closing the rams" as it is referred to in the industry. The actuation direction is shown by dashed arrow 682. According to some embodiments, preventer 200 is a variable bore ram blowout preventer. According to some other embodiment preventer 200 is a fixed-size ram preventer that is configured to seal around only a single pipe size.

Figure 3:
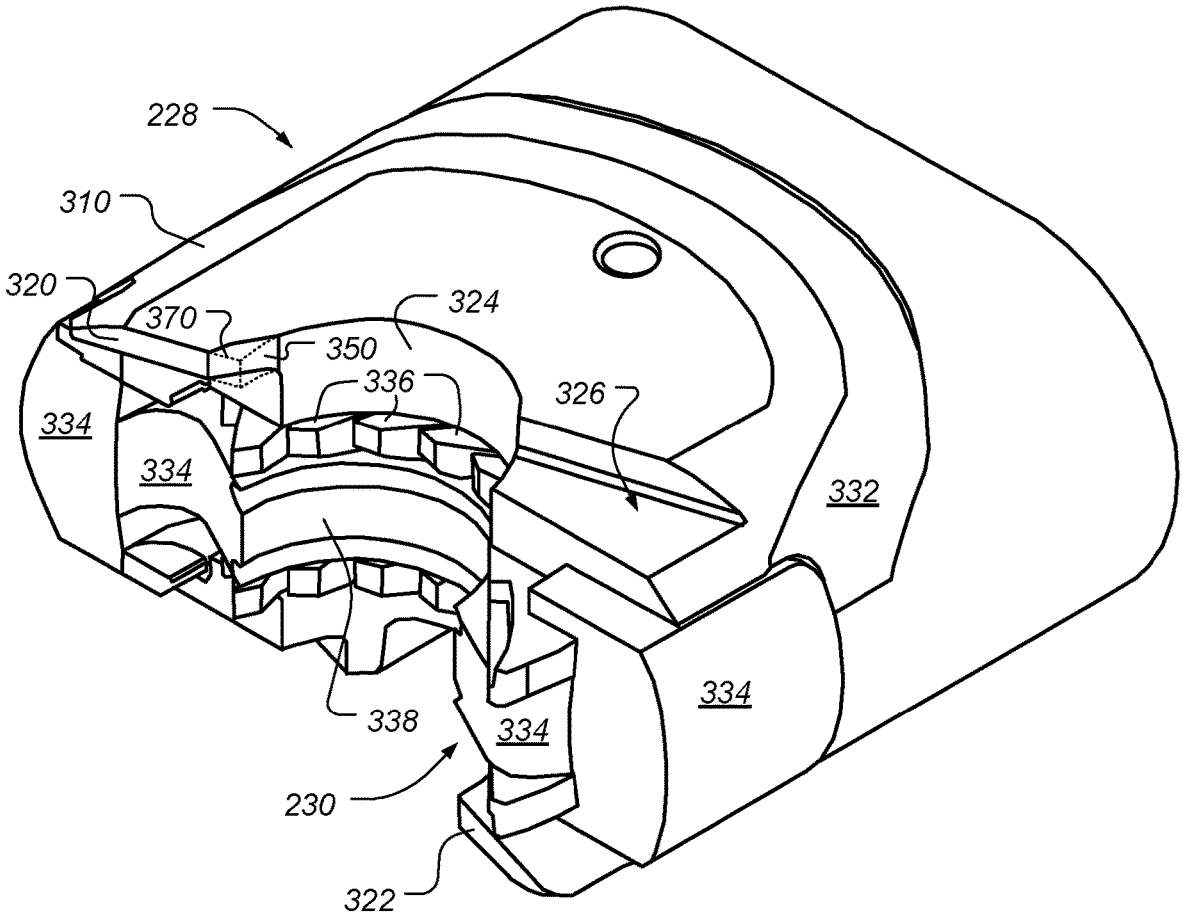
FIG. 3 is a perspective view of a ram assembly having improved hang off, according to some embodiments.

FIG. 3 is a perspective view of a ram assembly having improved hang off, according to some embodiments. Although a single ram assembly 228 is shown in FIG. 3 for clarity, it is understood that a second ram assembly would be included in a ram type blowout preventer such as preventer 200 shown in FIG. 2. Assembly 228 includes ram body 310 which generally houses packer assembly 230. Packer assembly 230 includes packer member 334 including a semi-circular sealing face 338 and is made of an elastomeric material. The ram body 310 surrounds packer member 334 and during a closing actuation forces packer member 334 towards a tubular (not shown) in vertical bore 125 (shown in FIGS. 1 and 2) such that the semi-circular sealing face 338 is forced into sealing contact with the tubular. Packer assembly 230 in this case also includes a number of insert plates 336 that are arranged around the central opening as shown. The insert plates 336 are configured to form an array that is sized to fit closely about a tubular member. In the case where ram assembly 228 forms part of variable bore ram blowout preventer, the insert plates 336 are configured to provide sealing over a range of tubular member sizes. Also shown in FIG. 3 is top seal 332 that can also be made of an elastomeric material.

The ram body 310 includes a semi-circular face 324 that can roughly match the sealing face 338 of packer member 334 and is shaped to accommodate a tubular (not shown) disposed in the wellbore that can be sealed against. Note that although the face 324 is referred to here and shown as semi-circular, in general the face is generally U-shaped and does not have to be strictly semi-circular in shape. On one side of the ram body 310, an upper centralizer lobe 320 is shown, and on the other side of the ram body 310 a lower centralizer lobe 322 is shown. The upper and lower centralizer lobes 320 and 322 are shaped such that when paired with an opposing ram body with similar or identical upper and lower centralizer lobes (see, e.g. FIG. 6), a tubular in the wellbore is forced to the center of the blowout preventer. In other words, if a tubular is off-center in the wellbore during a closing/sealing actuation of the blowout preventer, the centralizer lobes will guide the tubular towards the central opening of the preventer for proper sealing. As can be seen, the upper and lower centralizer lobes 320 and 322 are relatively thin so as to be able to mate with a notch formed in the opposing ram body. In FIG. 3, the upper notch 326 is shown, and is formed to accommodate an upper centralizer lobe on the opposing ram body (not shown).

In addition to housing the packer assembly 230 and centralizing a tubular as described, supra, ram body 310 can also be used to support an axial load, or hang off, where the BOP supports the weight of the portion of the drill string that is below the BOP. In such cases the axial hang off load is supported by a tool joint resting on the closed BOP. When being used for hang off, a shoulder of a tool joint will come into contact with the upper edge of the semi-circular face 324. In prior art variable bore ram blowout preventers, such as shown in commonly owned U.S. Pat. No. 8,727,303, incorporated by reference herein, the upper centralizer lobe 320 is shaped as shown by dotted outline 370. In such prior art designs, the front edge of the upper centralizer lobe 320 extends until it intersects with the semi-circular face 324. It has been found that in some cases during a hang off, a relatively large axial load is concentrated onto the "inner corner" of the centralizer lobe where it intersects with the semi-circular face. In some cases during a hang off, virtually the entire hang off load is concentrated onto four locations of prior art the ram bodies, two of which are the inner corners of the upper centralizer lobes of the two opposing ram bodies. According to some embodiments, a tapered section, 350, is provided on the upper centralizer lobe 320 of the ram body 310. The shape of tapered section 350 allow for the axial load of the tool joint shoulder to be effectively spread over a much larger area of ram body 310, namely along a large portion of the upper edge of the semi-circular face 324.

According to some embodiments, the ram assembly 228 and ram body 310 are used in a variable bore ram preventer, which is configured to seal around pipes of more than one size. According to some embodiments the diameter range of the different pipe sizes is at least than ½ inch, according to some embodiments the diameter range is at least 1 inch, and according to yet some other embodiments, the diameter range is at least 1½ inches. According to some embodiments, the ram assembly 228 and ram body 310 are used in a non-variable bore ram preventer (for fixed-size ram preventor) that is configured to seal only around a single pipe size. Note that even for a single pipe size there is a relatively small diameter range due to diameter tolerances. In the case of API SDP drill pipes the tolerances can be +/−0.79 mm for pipe sizes 4 inches and smaller, and +1.0%, −0.5% of diameter for sizes greater than 4 inches. Thus the diameter range for a single pipe size can be as high as 2-3 mm or about 1/10 inches even for fixed-size rams preventers.

Figure 4A:
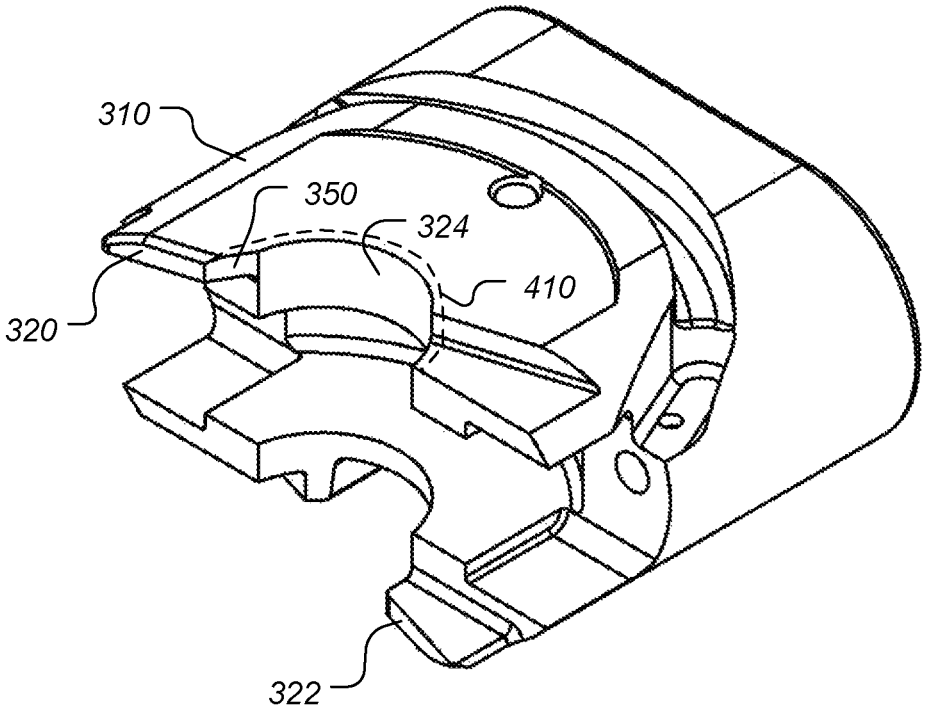
FIGS. 4A and 4B are perspective views of a ram body having improved hang off, according to some embodiments.
Figure 4B:
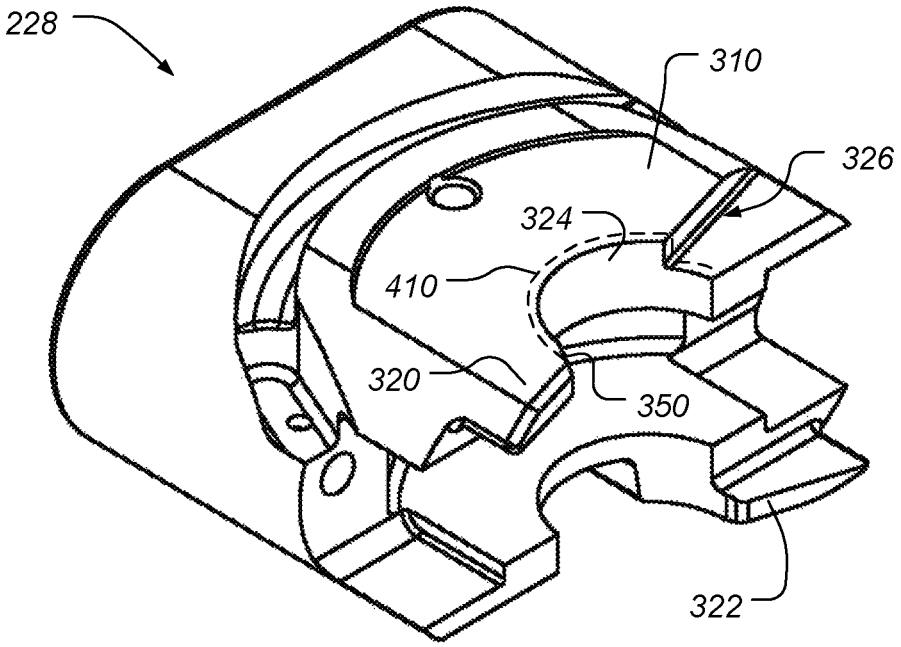

FIGS. 4A and 4B are perspective views of a ram body having improved hang off, according to some embodiments. FIGS. 4A and 4B show the ram body 310 without the packer assembly for clarity. Also shown with a dashed line 410 is the area of ram body 310 over which the hang off load is spread due to the introduction of tapered section 350. Note that either FIG. 4A or 4B could also depict the opposing ram body which is similar or identical to ram body 310.

Figure 5:
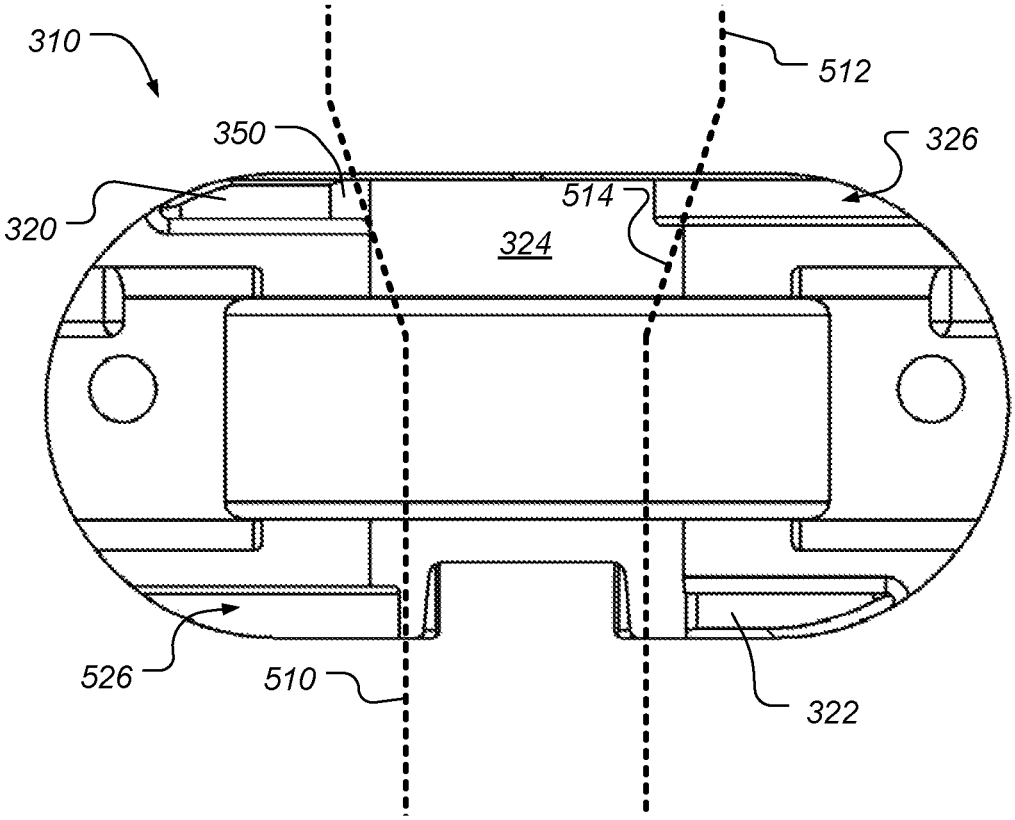
FIG. 5 is side view of a ram body having improved hang off, according to some embodiments.

FIG. 5 is side view of a ram body having improved hang off, according to some embodiments. Ram body 310 is shown viewed from the direction of the opposing ram. Also shown with a dotted lines outline is are a centrally disposed tubular section 510, tool joint 512 and tapered shoulder section 514. Note that the shoulder section is shown where it might contact ram body 310 during a hang off. The hang off load is spread over a larger area with tapered section 350 when compared with prior art designs without the tapered section 350. Also visible in FIG. 5 is lower notch 526 formed in body 310, which is shaped to mate with a lower centralizer lobe (like lobe 322) on the opposing ram body.

Figure 6:
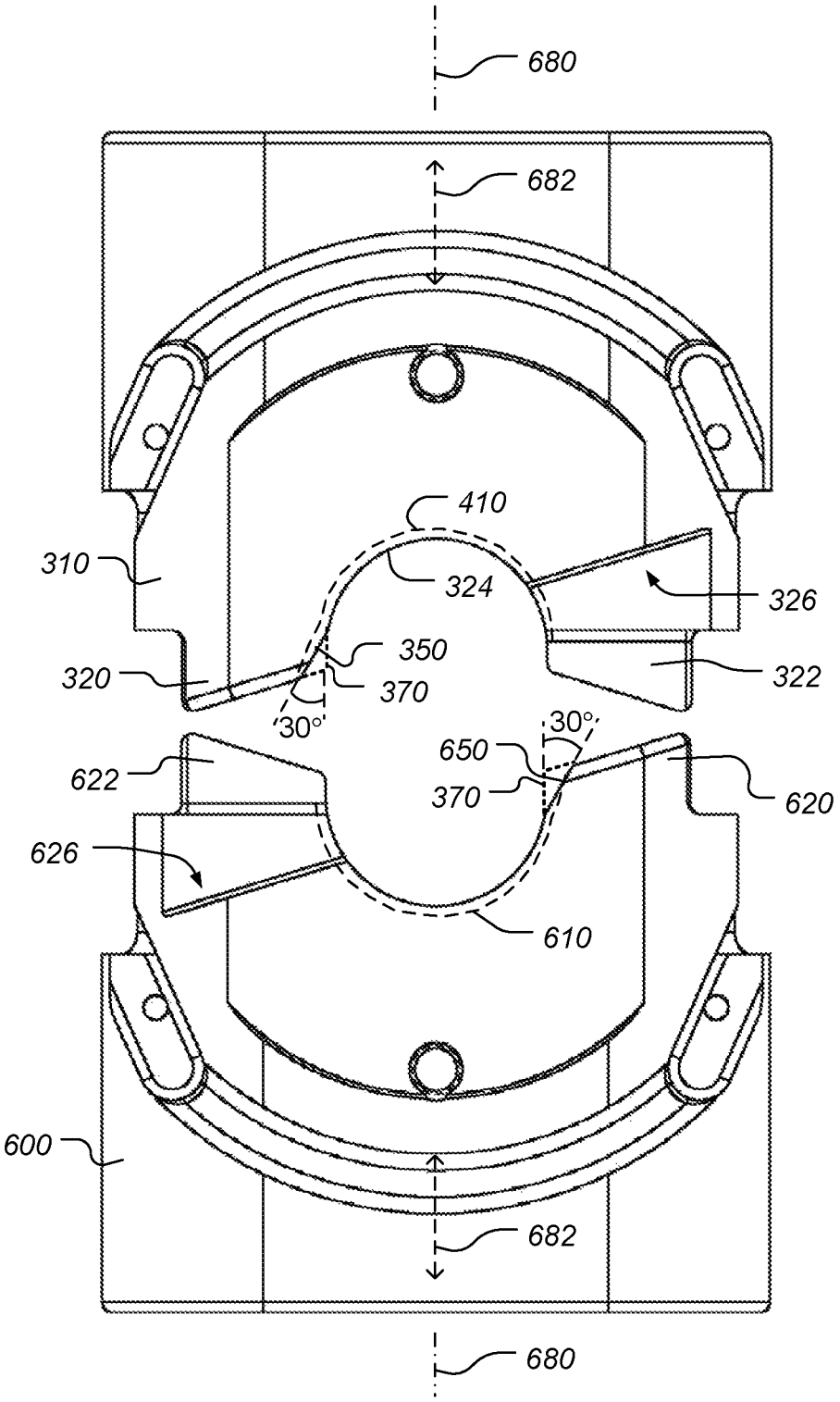
FIG. 6 is a top view of two opposing ram bodies that have improved hang off, according to some embodiments.

FIG. 6 is a top view of two opposing ram bodies that have improved hang off, according to some embodiments. Shown is ram body 310 and opposing ram body 600. Ram body 610 has upper and lower centralizer lobes 620 and 622 as shown. Upper notch 626 is also shown that is shaped to accommodate upper lobe 320 on body 310. In this example, the upper lobe 620 of body 600 has a tapered section 650 that is identical to the tapered section 350. The tapered sections 350 and 650 are shown being thirty degrees as measured from the prior art shown by dotted lines 370. Note that the prior art profile extends parallel to the direction of ram actuation (shown in dashed arrows 682) and parallel to the axis 680, therefore, the thirty degree taper of sections 350 and 650 can also be measured from line parallel the actuation direction 682 and/or axis 680.

Figure 7A:
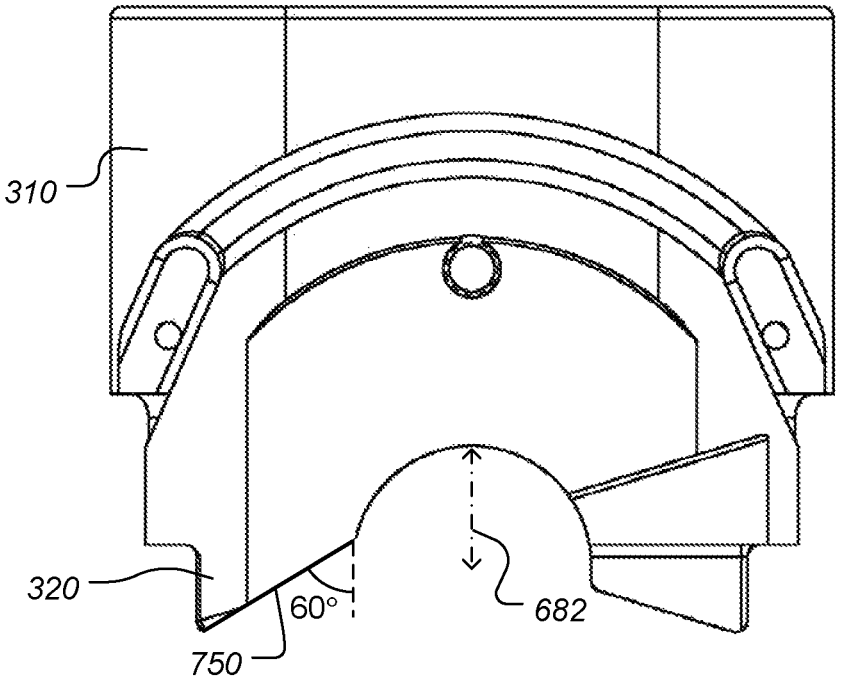
FIGS. 7A-7D are top views of ram bodies that have improved hang off, according to some embodiments.
Figure 7B:
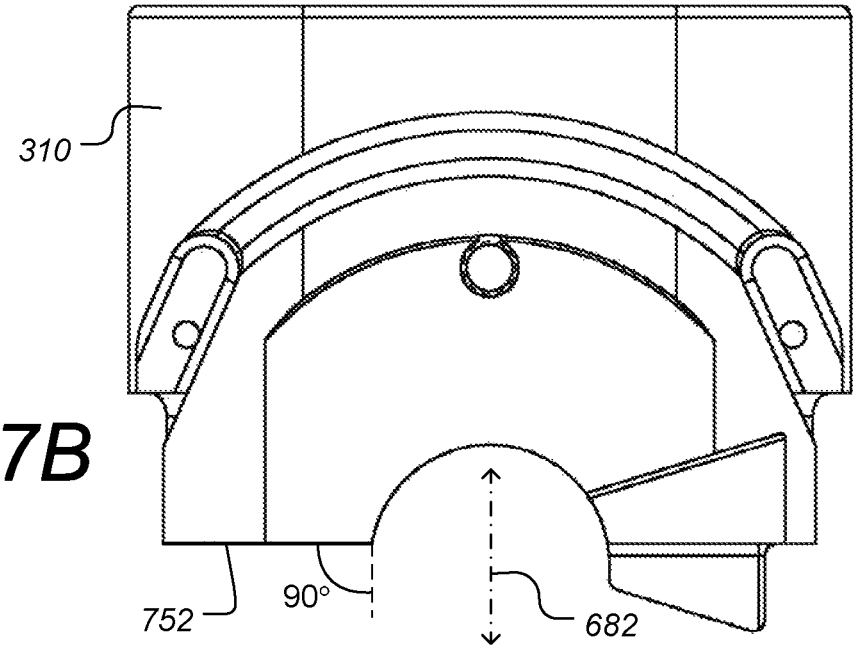
Figure 7C:
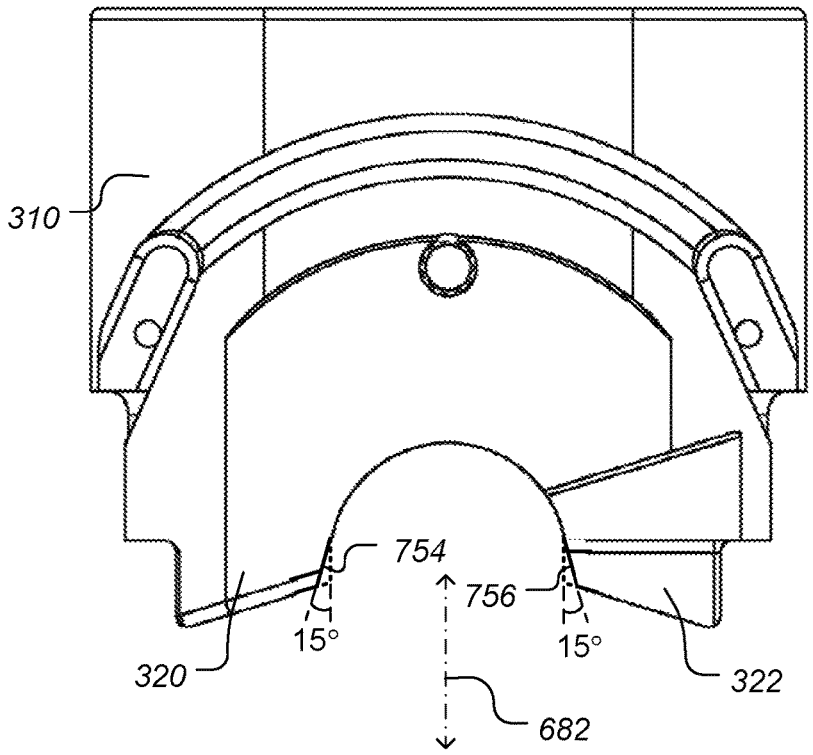
Figure 7D:
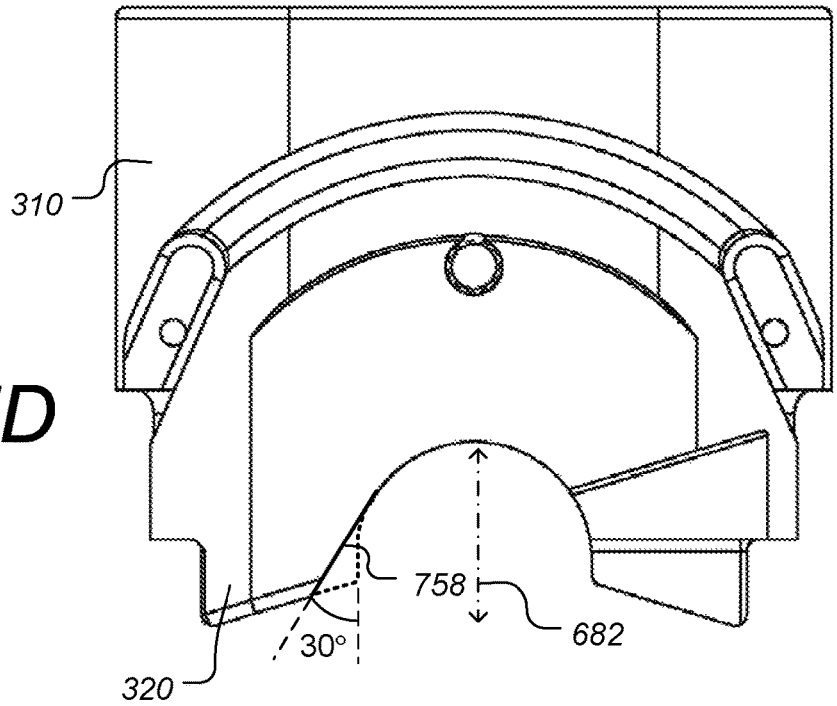

FIGS. 7A-7D are top views of ram bodies that have improved hang off, according to some embodiments. FIGS. 7A-7D show variations of ram body tapers for improving hang off. FIG. 7A shows ram body 310 having upper centralizer lobe 320 with a taper section 750 that is 60 degrees measured from the ram actuation direction 682. FIG. 7B shows ram body 310 having a taper section 752 that is 90 degrees measured from the ram actuation direction 682. Note that in this case, the entire upper centralizer lobe may be omitted. FIG. 7C shows ram body 310 having upper centralizer lobe 320 with a taper section 754 that is 15 degrees measured from the ram actuation direction 682. Additionally, the lower centralizer lobe 322 includes a taper section 756 that also is 15 degrees measured from the ram actuation direction 682. FIG. 7D shows ram body 310 having upper centralizer lobe 320 with a taper section 758 that is 30 degrees measured from the ram actuation direction 682, but the taper 758 starts further back (away from the opposing ram) than taper 350 shown in FIGS. 3, 4A, 4B, 5 and 6, where the taper section starts approximately where the semi-circular opening 324 is approximately parallel to the ram actuation direction. According to some embodiments, as measured parallel to the ram actuation direction, the taper can range from 5 degrees to 90 degrees and can be on the upper lobe and/or lower lobe. According to some embodiments, as measured parallel to the ram actuation direction, the taper can range from 10 degrees to 60 degrees and can be on the upper lobe and/or lower lobe. According to some embodiments, as measured parallel to the ram actuation direction, the taper can range from 20 degrees to 45 degrees and can be on at least the upper lobe. According to some embodiments, as measured parallel to the ram actuation direction, the taper can range from 10 degrees to 60 degrees and can be on the upper lobe and/or lower lobe. According to some embodiments the taper start location can be anywhere along the central opening. According to some embodiments, the central opening doesn't have to be circular, but rather has a profile that is shaped to improve hang off load. In general, the amount and location of the tapered section(s) and/or the profile and shape of the central opening of the ram body should be selected based on one or more of the following: shape and thickness of centralizer lobes, shape of central semi-circular ram body opening, anticipated tubing sizes, anticipated tool joint shoulder profiles, and anticipated hang off loads.

Figure 8A:
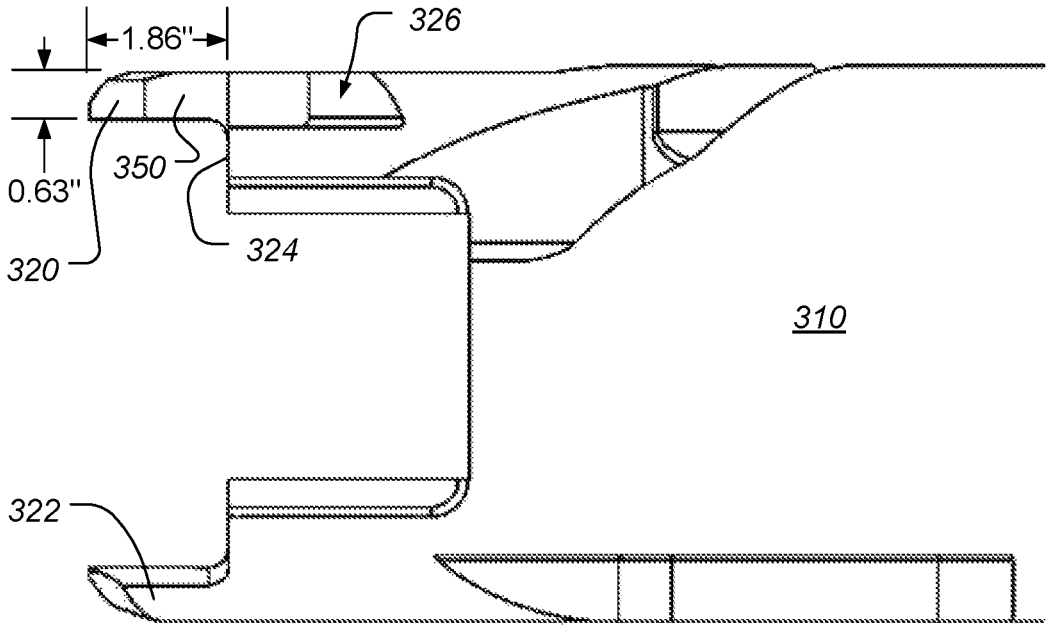
FIGS. 8A and 8B are side are top views of ram bodies that have improved hang off, according to some embodiments.
Figure 8B:
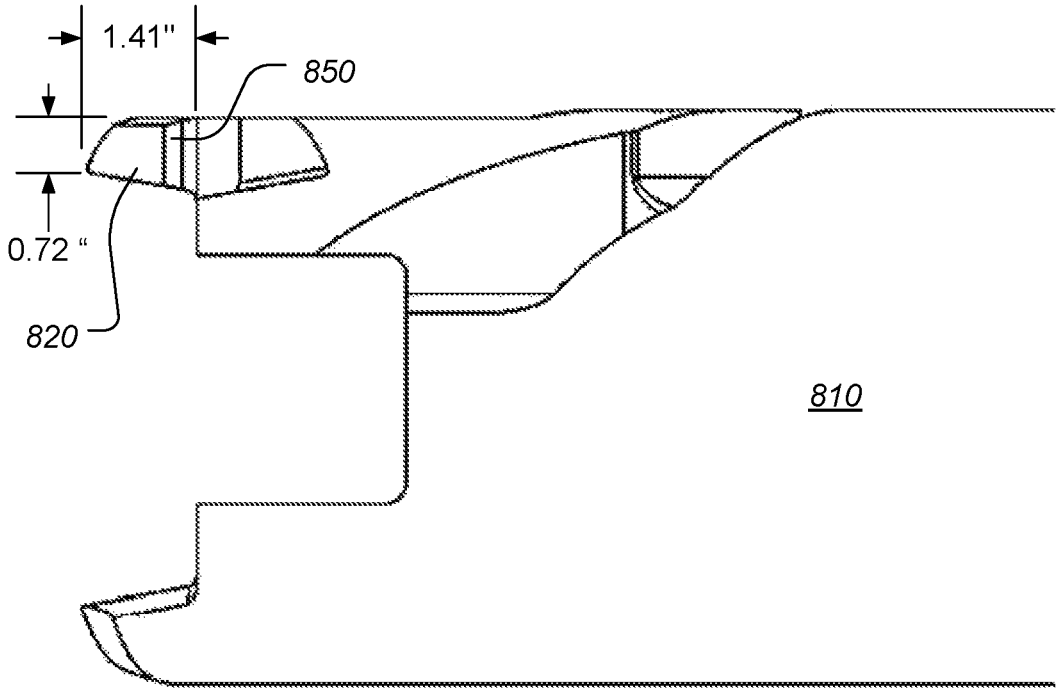

FIGS. 8A and 8B are side are top views of ram bodies that have improved hang off, according to some embodiments. FIG. 8A is a side view of ram body 310 such as shown in FIGS. 3, 4A, 4B, 5, 6 and 7A. The dimensions of upper centralizing lobe 320 is shown for this example. In particular the length of lobe 320 is about 1.86 inches (47.4 mm) and the thickness of lobe 320 is about 0.63 inches (16 mm). In general, the longer and thinner the centralizing lobe, the greater the benefit for a taper (such as taper 350) or other shape to improve hang off capability. FIG. 8B is a side view of a different ram body 810 that has a centralizing lobe 820 that is shorter (1.41 inches-35.8 mm) and thicker (0.72 inches-18.2 mm) than lobe 320 of body 310. In the case shown in FIG. 8B, the shorter and thicker centralizing lobe 820 nevertheless benefits from a tapered section 850 for improved hang off capability. According to some embodiments, a tapered section is found to improve hang off for ram bodies having an upper centralizing lobe this a length of greater than about 1 inch and thinner than about 1 inch.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A ram assembly used in a ram type blowout preventer configured to form a seal against a tubular member extending into a wellbore, comprising:

a packer assembly including at least one packer member having a substantially U-shaped face to form the seal against the tubular member; and a ram body configured to house said packer assembly and when actuated in a ram actuation direction towards the tubular member pushes said U-shaped face on the packer assembly against the tubular member, the ram body including:

an upper U-shaped face generally aligned with the U-shaped face of the packer assembly;

an upper centralizing lobe shaped and positioned to aid in moving the tubular member towards a central position with respect to the U-shaped face of the packer assembly;

a tapered section having a tapered face between the upper centralizing lobe and the upper U-shaped face; and the upper U-shaped face of the ram body, the ram body upper U-shaped face and/or the upper centralizing lobe being shaped to increase hang off capacity of the preventer.

2. A ram assembly according to claim 1 wherein the ram type blowout preventer is a variable ram blowout preventer and a diameter range of the tubular is at least ¼ inch.

3. A ram assembly according to claim 2 wherein the ram type blowout preventer is a variable ram blowout preventer and the diameter range of the tubular is at least ½ inch.

4. A ram assembly according to claim 3 wherein the ram type blowout preventer is a variable ram blowout preventer and the diameter range of the tubular is at least 1 inch.

5. A ram assembly according to claim 1 wherein the ram type blowout preventer is a fixed-size ram blowout preventer and a diameter range of the tubular is less than ¼ inch.

6. A ram assembly according to claim 1 wherein the improvement of hang off capacity is due at least in part on the tapered section having a tapered face formed at an intersection of the ram body upper U-shaped face and the upper centralizing lobe.

7. A ram assembly according to claim 1 wherein the tapered face includes a planar surface that is at an angle between 5 and 90 degrees from the ram actuation direction.

8. A ram assembly according to claim 7 wherein the planar surface is at an angle between 10 and 75 degrees from the ram actuation direction.

9. A ram assembly according to claim 8 wherein the planar surface is at an angle between 15 and 60 degrees from the ram actuation direction.

10. A ram assembly according to claim 9 wherein the planar surface is at an angle between 20 and 45 degrees from the ram actuation direction.

11. A ram assembly according to claim 10 wherein the planar surface is at an angle of about 30 degrees from the ram actuation direction.

12. A ram assembly according to claim 1 wherein the ram body further includes a lower centralizing lobe that is shaped and positioned to aid in moving the tubular member towards a central position with respect to the U-shaped face of the packer assembly and the upper U-shape face of the ram body.

13. A ram assembly according to claim 1 wherein the upper centralizing lobe protrudes in the ram actuation direction at least 1 inch.

14. A ram assembly according to claim 13 wherein the upper centralizing lobe protrudes in the actuation direction at least 1½ inches.

15. A ram assembly according to claim 1 wherein the upper centralizing lobe is less than 1 inch thick.

16. A ram assembly according to claim 15 wherein the upper centralizing lobe is less than ¾ inches thick.

* * * * *